US006109002A

United States Patent [19]

McCabe

[11] Patent Number: 6,109,002

[45] Date of Patent: Aug. 29, 2000

[54] APPARATUS AND METHOD FOR SUPPORTING AND PROTECTING A BAG DURING COMPACTING OF WASTE

[76] Inventor: James K. McCabe, 323 E. Maconi, Phoenix, Ariz. 85022

[21] Appl. No.: 09/167,070

[22] Filed: Oct. 6, 1998

[51] Int. Cl.[7] ..... B65B 67/12

[52] U.S. Cl. ..... 53/390; 53/255; 53/527; 53/575; 220/495.08; 220/495.1; 248/97; 248/98; 248/99; 248/101

[58] Field of Search ..... 53/255, 258, 260, 53/390, 527, 575, 576; 220/495.06, 495.08, 495.1, 495.11; 248/95, 97, 98, 99, 100, 101

[56] References Cited

U.S. PATENT DOCUMENTS

| | | | |
|---|---|---|---|
| 1,503,183 | 7/1924 | Bailey . | |
| 1,612,986 | 1/1927 | Reynolds . | |
| 1,698,683 | 1/1929 | Reynolds . | |
| 3,405,744 | 10/1968 | Bowman | 53/527 X |
| 3,528,366 | 9/1970 | Neuenburg et al. | 53/527 X |
| 3,727,546 | 4/1973 | McKinney | 53/527 X |
| 3,765,148 | 10/1973 | Ippolito et al. | 53/527 |
| 3,834,299 | 9/1974 | Bourgeois et al. | 53/527 X |
| 3,868,903 | 3/1975 | Montalbano | 53/527 X |
| 3,915,329 | 10/1975 | Zaks | 383/119 X |
| 3,997,072 | 12/1976 | Guth . | |
| 4,014,157 | 3/1977 | Pearce | 53/390 X |
| 4,037,778 | 7/1977 | Boyle | 53/390 X |
| 4,167,271 | 9/1979 | Jorgensen . | |
| 4,222,580 | 9/1980 | Krokonko . | |
| 4,268,081 | 5/1981 | Hawkinson . | |
| 4,312,531 | 1/1982 | Cross . | |
| 4,326,575 | 4/1982 | Larkin . | |
| 4,457,483 | 7/1984 | Gagne | 383/119 X |
| 4,628,007 | 12/1986 | Ledsham | 383/104 X |
| 4,643,380 | 2/1987 | Copeland . | |
| 4,749,011 | 6/1988 | Rylander | 53/390 X |
| 4,842,228 | 6/1989 | Kasper . | |
| 4,890,652 | 1/1990 | Hoerner | 53/390 X |
| 4,955,496 | 9/1990 | Nelson | 383/104 X |
| 4,979,547 | 12/1990 | Hoerner | 53/390 X |
| 5,295,606 | 3/1994 | Karwoski . | |
| 5,358,138 | 10/1994 | Karwoski . | |
| 5,497,897 | 3/1996 | Alack et al. . | |
| 5,737,903 | 4/1998 | Minutillo | 53/390 X |
| 5,768,988 | 6/1998 | Meloni | 53/527 X |
| 5,806,416 | 9/1998 | Cerniglia et al. | 53/390 X |

FOREIGN PATENT DOCUMENTS

| | | | |
|---|---|---|---|
| WO 94/11253 | 5/1944 | WIPO | 53/390 |

*Primary Examiner*—Daniel B. Moon

*Attorney, Agent, or Firm*—Edwin A. Suominen; Squire, Sanders & Dempsey L.L.P.

[57] ABSTRACT

An apparatus protects a bag so that waste may be compacted into the bag. The apparatus includes a shield having an upper shield opening and a lower shield opening, and a base that is constructed so that it may be secured, in a releasable fashion, to the lower shield opening. The shield separates the bag from compacted waste. The base cooperates with the shield to support the bag and its contents. The shield is placed almost entirely into the bag, the lower opening of the shield being secured to the base at an interface. Compacted waste rests on the bottom of the bag, which may be supported by the base. When the bag has become filled with waste, the shield is removed.

6 Claims, 7 Drawing Sheets

APPARATUS AND METHOD FOR SUPPORTING AND PROTECTING A BAG DURING COMPACTING OF WASTE

BACKGROUND OF THE INVENTION

Many types of loose waste, including yard waste such as leaves and trimmed branches from trees, may be compacted to occupy a significantly reduced volume. Such waste can be compacted easily by hand when disposed in a rigid receptacle. For example, persons typically compact yard waste simply by compressing the waste in a barrel to make room for additional yard waste. Compacting such waste is desirable because space is conserved (1) in the receptacle and (2) in whatever larger receptacle is used to transport the waste to its ultimate destination.

It is also desirable for the waste to be in a compacted state when it is processed (for example by composting and mulching) at its ultimate destination. More waste may be processed per unit volume when it has been compacted than if it is left in an uncompacted state. Further, if the waste is stored in a landfill, it takes up less landfill space when compacted.

A person handling loose waste, such as a yard worker, often chooses flexible bags for waste disposal instead of a rigid receptacle. Flexible bags are often used because there is too much waste to fit into the single rigid receptacle that the typical household has available for waste disposal. Many municipalities require such waste to be bagged. In addition, bags are more convenient to use than a rigid receptacle because they are lighter and easier to carry when filled.

It is desirable for loose waste to be compacted when it is disposed of in flexible bags. The benefits noted above could be obtained, as well as a reduction in the number of bags required to contain a given amount of waste. If fewer bags were used, the consumer would enjoy cost savings and the environmental demands associated with production of the bags would be diminished.

However, flexible bags tear easily when certain types of waste, such as tree branches or aluminum cans, are compacted inside them. Because of this, much of the loose waste presently disposed of in flexible bags is not compacted as much as it could be in a rigid receptacle. Accordingly, the cost savings, convenience, and environmental benefits of compacted waste are often not realized.

SUMMARY OF THE INVENTION

An apparatus according to the present invention protects a bag so that waste may be compacted into the bag. Such an apparatus includes a shield having an upper shield opening, a lower shield opening, and a base. The base is constructed so that it may be secured, in a releasable fashion, to the lower shield opening. The shield substantially protects the bag from abrasion by compacted waste. The base cooperates with the shield to support the bag and its contents.

The base prevents substantial contact between the bag and the surface on which the base rests. The base also supports the bottom of the bag when waste is compacted into the bag.

In operation, the shield is placed almost entirely into the bag, the lower opening of the shield being secured to the base at an interface. The bag extends across the base and provides a reliable mechanical interface between the durable portions of the apparatus, the base and the lower shield opening. This interface helps to reduce abrasive wear on these durable portions when they are repeatedly secured to each other and then released. The bag is replaced each time the durable portions of the apparatus are separated, so it is not affected by long-term abrasive wear from repeated mechanical connections.

Compacted waste rests on the bottom of the bag, which is supported by the base. The shield does not bear any of the weight of the compacted waste. When the shield is removed, the weight of the compacted waste provides a downward force on the base. When the bag has become suitably filled with waste, this downward force helps to keep the base stationary while the shield is removed.

In a variation, the shield is tapered to be narrower at its top. A tapered shield tends to move more easily away from compacted waste. A number of tapered shields may be stacked together during storage and/or shipment.

BRIEF DESCRIPTION OF THE DRAWINGS

Embodiments of the present invention will now be further described with reference to the drawing, wherein like designations denote like elements and.

DESCRIPTION OF PREFERRED EXEMPLARY EMBODIMENTS

An apparatus for supporting and protecting a bag during compacting of waste into the bag includes a shield and a base. Any suitable shield that has an upper shield opening and a lower shield opening may be used to substantially protect the bag from abrasion by compacted waste. Waste is inserted into a bag (in which the shield is placed) through the upper shield opening. Any suitable base may be used to support the shield and bag. A suitable base is capable of being secured to the lower shield opening in a releasable fashion so that the base may be (1) secured to the shield while the apparatus is in use and (2) removed from the shield when the bag is to be replaced.

Figure 1:
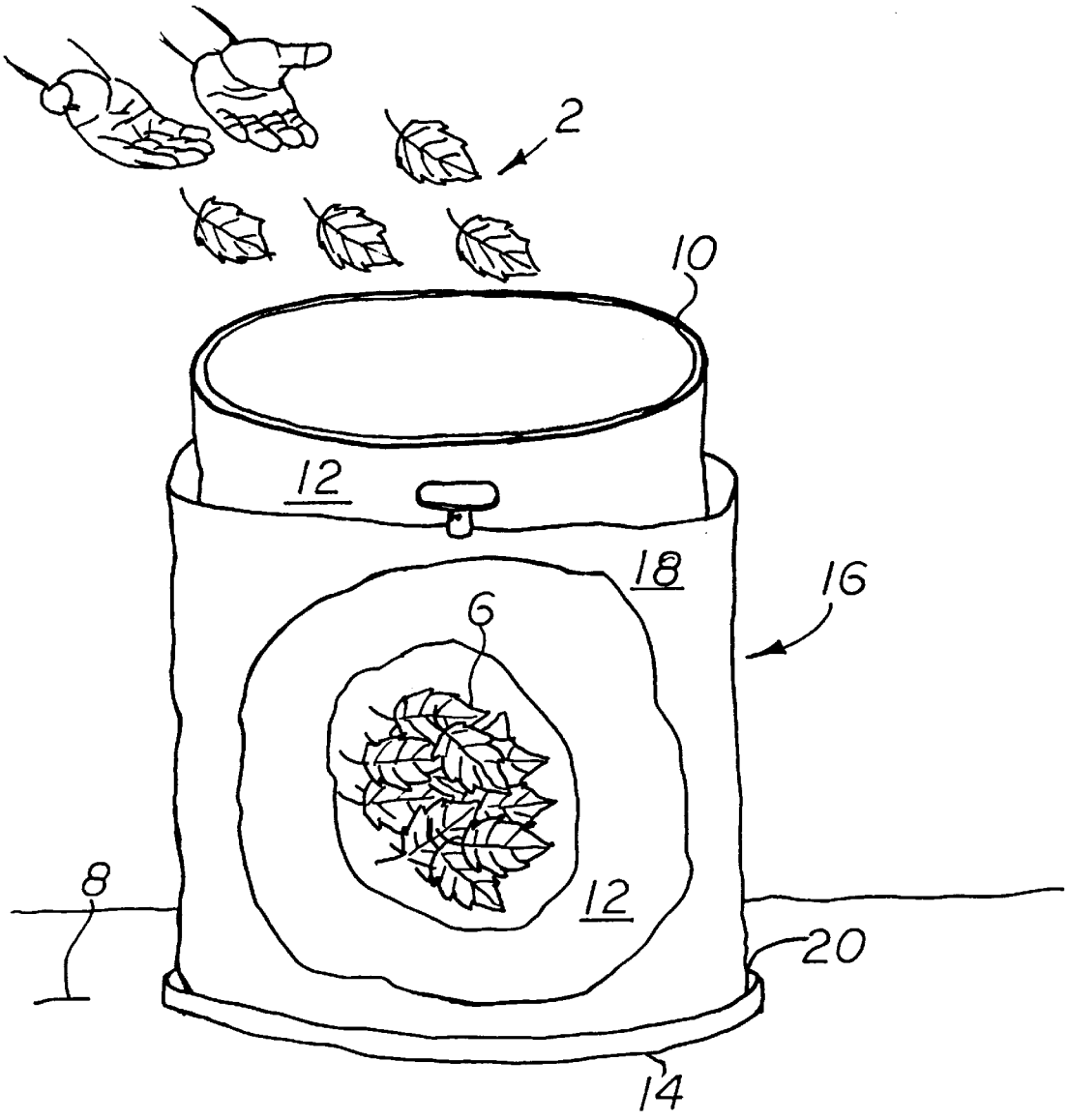
FIG. 1 is a perspective view of an embodiment of the present invention being used to compact leaves into a bag.

Referring to FIG. 1, an apparatus 16 for disposal of waste, (e.g., leaves 2) comprises a shield and a base 14 in cooperation with bag 18. Shield 12 is received in bag 18 and holds it in place. Base 14 supports the bottom of bag 18. Bag 18 rests on base 14 and surrounds the vertical portion of shield 12. Shield 12 and base 14 are secured together with bag 18 sandwiched between them. Bag 18 is made of any suitably thin and flexible material, preferably a suitable plastic film or paper product. Such material allows base 14 and shield 12 to be secured to each other through bottom 20 of bag 18. Shield 12 is positioned inside of bag 18, while base 14 is positioned outside of bag 18 and, consequently, outside shield 12. As shown, apparatus 16, along with bag 18, rests on a surface 8.

Bag 18 is preferably stretched over shield 12 while shield 12 is in an inverted position. In such a position, upper shield opening 10 rests on surface 8. Bag 18 and shield 12 may then be inverted as a unit and placed onto base 14. Shield 12 and base 14 are secured to each other in a releasable fashion through bag 18. Thus, lateral and rotational motion between shield 12 and base 14 is substantially prevented.

When apparatus 16 is used for compacting leaves into a bag, new leaves 2 are added to compacted leaves 6 already present inside bag 18. Leaves 2 are added to bag 18 through upper shield opening 10. Shield 12 also has a lower opening, which is not shown in FIG. 1 because it is obscured in this view by bag 18.

When leaves 6 are compacted, shield 12 protects bag 18 from abrasion. When bag 18 is sufficiently filled with compacted leaves, base 14 is released from bag 18 and shield 12. Then, shield 12 is pulled up and out of bag 18, and bag 18 stands alone containing compacted leaves 6. At this point, bag 18 can stand without support because it is full of compacted waste, and may be tied shut for disposal.

Figure 2:
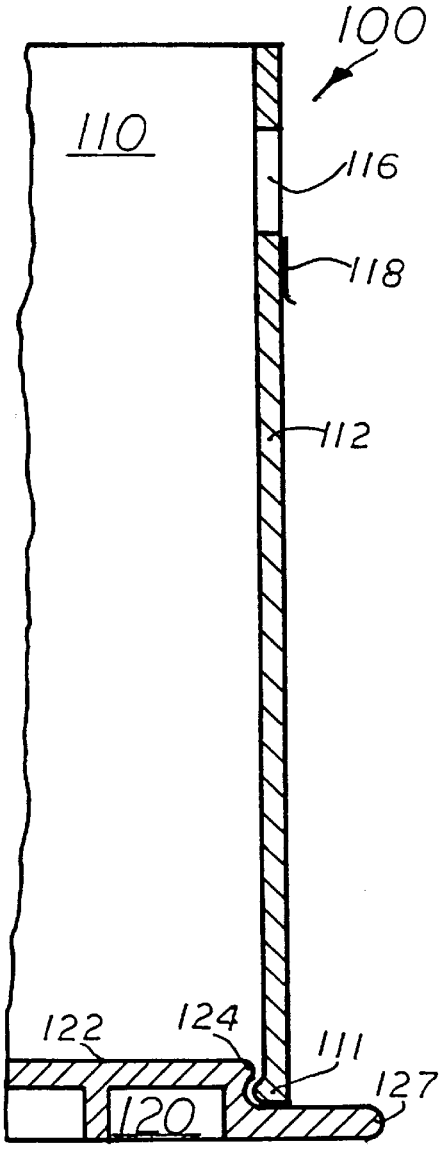
FIG. 2 is a cutaway view of an embodiment of the invention having a cylindrical shield and a circular base.
Figure 9:
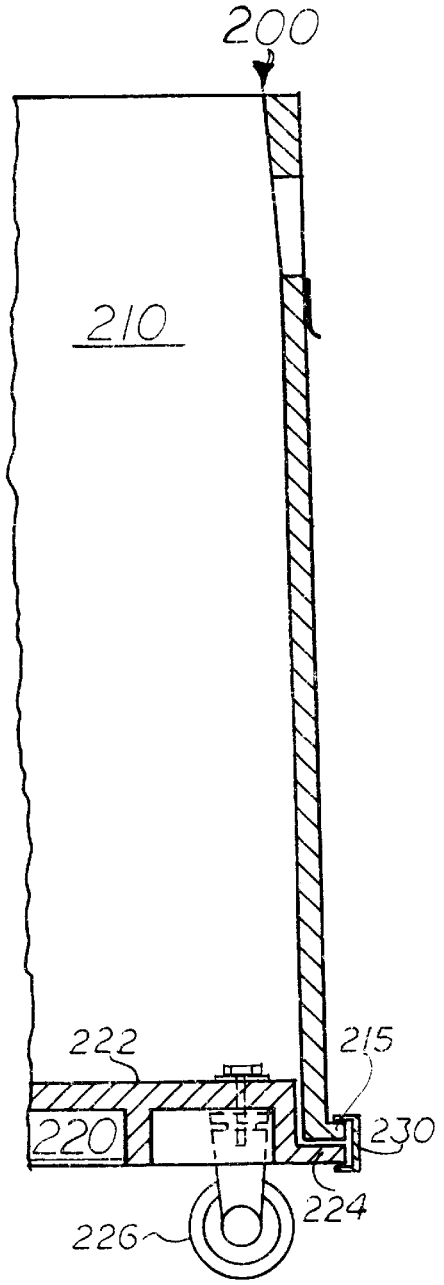
FIG. 9 is a cutaway view of an embodiment of the invention having a tapered cylindrical shield and a circular base with wheels.
Figure 18:
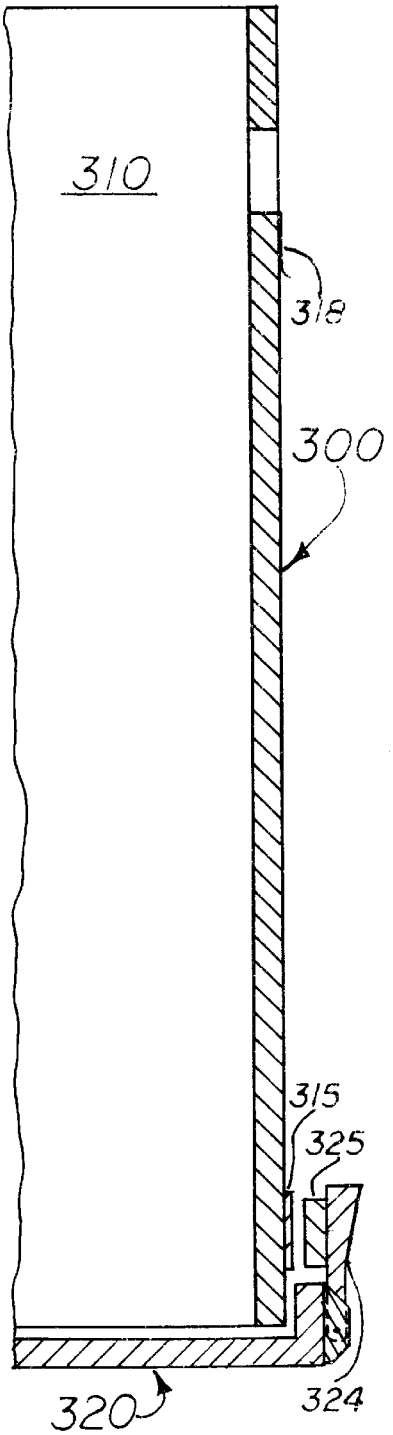
FIG. 18 is a cutaway view of an embodiment of the invention having a box-shaped shield and a rectangular base.

According to the invention, any suitable shield and any suitable base may be secured to each other to support and protect a bag during compacting of waste into the bag. FIGS. 2, 9, and 18 show examples of apparatus having suitable shields and bases secured to each other. These examples are intended to show preferred exemplary embodiments of the invention rather than to limit it. FIG. 2 shows an apparatus 100 having a cylindrical shield 110 and circular base 120. FIG. 9 shows an apparatus 200 having a tapered cylindrical shield 210 and a base 220 having a raised inner face 222 and wheels 226. Apparatus 200 also includes a clip ring 230, which secures base 220 to shield 210 in a releasable fashion. FIG. 18 is an apparatus 300 having a box-shaped shield 310 and square base 320.

Figure 3:
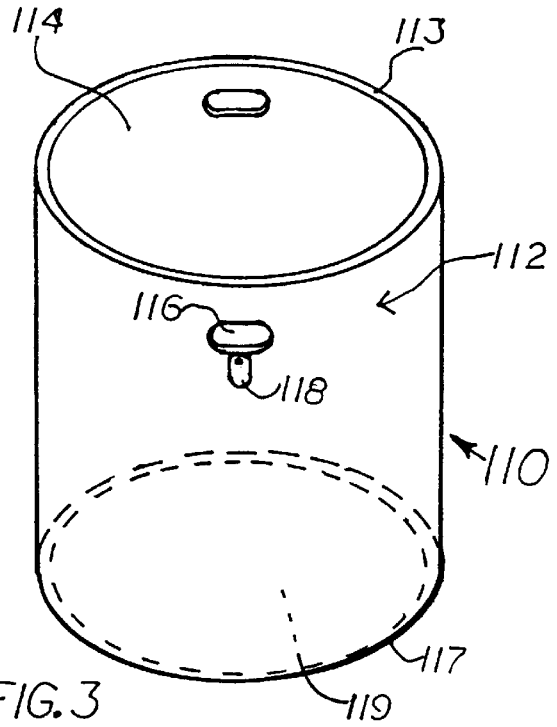
FIG. 3 is a perspective view of a cylindrical shield according to an aspect of the present invention.
Figure 5:
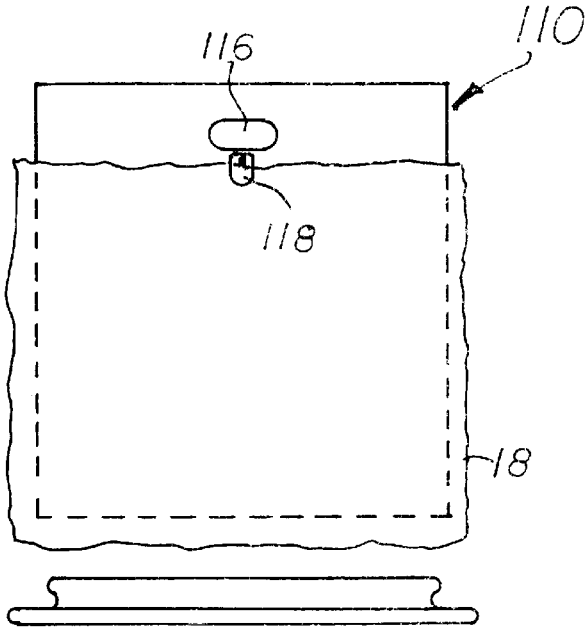
FIG. 5 shows a shield of the present invention placed partially into a bag and onto a base.

Shield 110, shown in FIG. 3, has a cylindrical shell 112, a circular rim 113 that defines an upper shield opening 114, and another circular rim 117 that defines a lower shield opening 119. Upper shield opening 114 is sized to fit within the open mouth of conventional waste bag 18 is as shown in FIG. 5. Shell 112 includes two handles 116. Preferably, handles 116 are openings formed in shell 112. A spring clip 118 is attached to each handle 116.

FIG. 5 shows shield 110 placed almost entirely into bag 18. Clip 118 secures bag 18 to shield 110, thus allowing shield 110 to support bag 18. Additional clips may be provided around the circumference of shield 110 to further secure bag 18.

Figure 7:
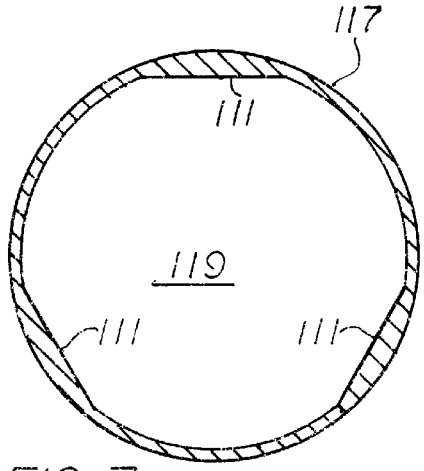
FIG. 7 is a bottom view of a cylindrical shield having a shield coupling lip in three places according to an aspect of the present invention.
Figure 6:
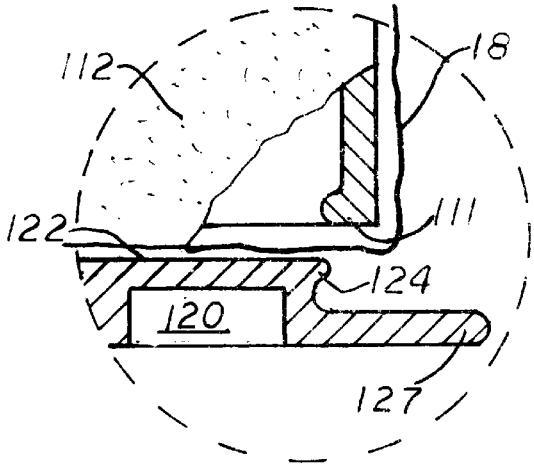
FIG. 6 is a magnified cutaway view of the shield and base of FIG. 5.

FIG. 6 is an enlarged cutaway view of shield 110 showing a shield coupling lip 111, which is formed from a thickening of shell 112 at points around rim 117 of lower shield opening 119. FIG. 7 is a section view of rim 117 of lower shield opening 119, showing three thickened areas that form shield coupling lip 111. Rim 117, as illustrated in FIG. 7, is thickened in selected portions. In a variation, rim 117 of lower shield opening 119 is thickened around its entire circumference to form a continuous lip 111. In another variation, rim 117 is thickened to form lip 111 only in portions that are directly underneath handle 116. Such an alternative arrangement allows upward force to be transmitted directly from handle 116 to shield coupling clip 111 when shield 110 is released from base 120.

Base 120 has a raised inner face 122 with a base coupling lip 124 around its edge. In a preferred embodiment, shield coupling lip 111 and base coupling lip 124 engage each other to secure shield 110 to base 120 in a releasable fashion. Lower lip 127 of base 220 extends out beyond lower rim 17 of shield 110 to aid in releasing base 220 from the shield 120.

Figure 10:
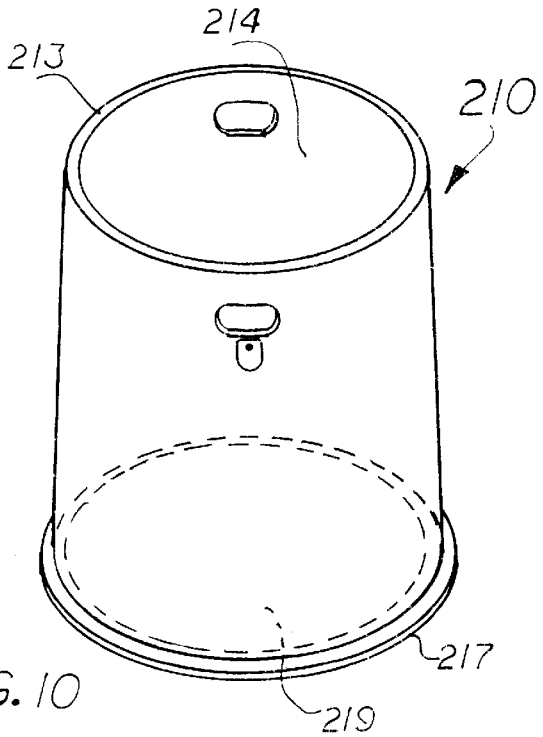
FIG. 10 is a perspective view of a tapered cylindrical shield according to an aspect of the present invention.

Shield 210, shown in FIG. 10, has a tapered cylindrical shape. Accordingly, upper shield opening 214 (defined by rim 213) is smaller in area than lower shield opening 219. Lower shield opening 214 is sized to pass into the open mouth of conventional waste bag, and preferably has a radius in a range from about 16 inches to about 24 inches. In a variation, a larger or smaller size may be used.

Lower shield opening 219 is defined by a rim 217 having an outward-extending lip 215. Base 220 has a similar outward-extending lip 224. Lip 224 of base 220 is sized to receive the bottom surface of lip 215 of shield 210. As shown in FIG. 9, lip 215 of shield 210 and lip 224 of base 220 may be secured together in a releasable fashion by clip 230.

Figure 13:
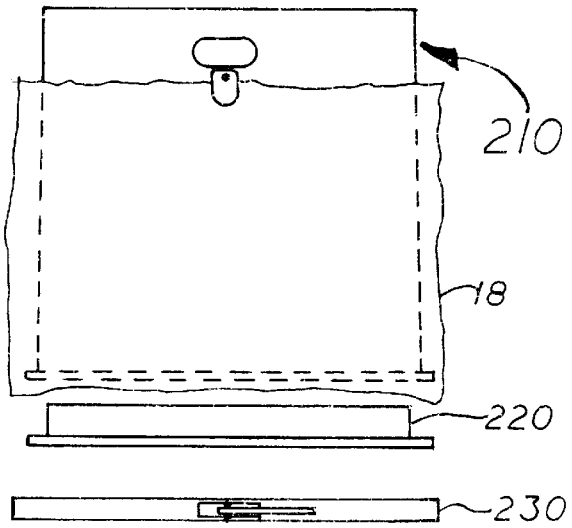
FIG. 13 shows a shield of the present invention placed partially into a bag and onto a base.

FIG. 13 shows shield 210 placed almost entirely into a bag 18. Base 220 rests below bag 18 such that bag 18 may be sandwiched between shield 210 and base 220 when they are secured together by clip 230. FIG. 13 does not show wheels 226, which are preferably present on base 220.

Shield 210 may be inverted while bag 18 is stretched down over it. Then bag 18 and shield 210 may be inverted again to an upright position and placed onto base 220. Clip ring 230 may then be fastened onto lip 215 of lower shield opening 219 and lip 224 of base 220, securing shield 210 and base 220 together.

Figure 16:
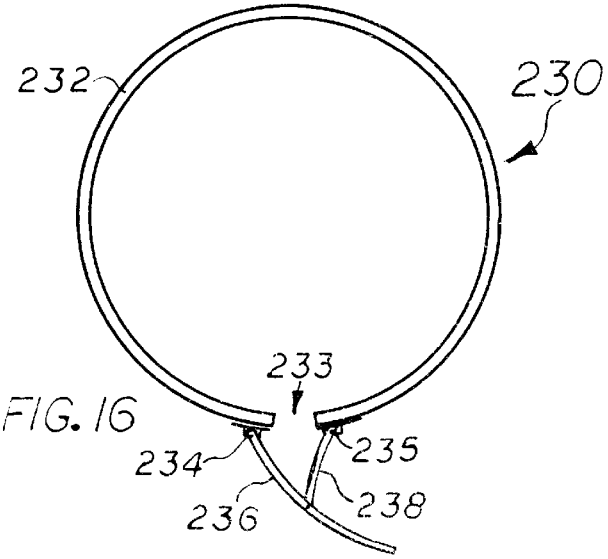
FIG. 16 shows a clip ring according to an aspect of the present invention.
Figure 17:
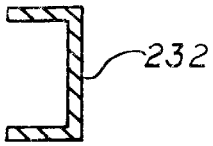
FIG. 17 is a cutaway view of the clip ring of FIG. 16.

Any suitable clip ring may be used to secure a shield and a base of the present invention together. A clip ring 230 that may be made from a ring 232 of metal or, alternatively, plastic channel having a small gap 233 is illustrated in FIGS. 16 and 17. Gap 233 is bridged with a latch 236 having an inner member 238. Latch 236 and member 238 are connected to ring 232 by respective hinges 234 and 235. Clip ring 230 is tightened by closing latch 236 onto member 238, thereby narrowing gap 233. In a variation, clip ring 230 is formed with ring 232 made of a suitable elastic material that may be stretched over a base and a shield.

A shield of the present invention may be suitably sized so that a lower shield opening is at approximately waist height when the shield is inverted. Accordingly, it may be more convenient for some users to place a base of the invention onto such a shield while the shield is in an inverted position. For example, base 220 may be placed onto inverted shield 210. Clip ring 230 may then be placed onto lip 215 and lip 224. Apparatus 200, having shield 210 and base 220 thus secured together, may then be inverted to an upright position.

The tapered cylindrical shape of shield 210 is advantageous in that it tends to move more easily away from compacted waste. In addition, a number of tapered shields may be stacked together during storage and/or shipment. These advantages may be obtained with any suitable tapered shield. Upper shield opening 214 is suitably sized large enough for receiving waste into the bag while remaining smaller in area than lower shield opening 219.

Shield 210, base 220, and clip ring 230 may be produced by modifying a conventional thirty-gallon blue poly drum. A suitable drum is an "OT" drum, marketed by the Conpico Company and available as unit number DRU-7145-P from the Sun West Container Company of Phoenix, Ariz. The bottom of such a drum may be cut off to form upper shield opening 214. Material may be removed from near the bottom of the drum to form handles 116. The lid of the drum may be used as base 220. A ring provided with the drum may be modified to be used as clip ring 230.

Figure 19:
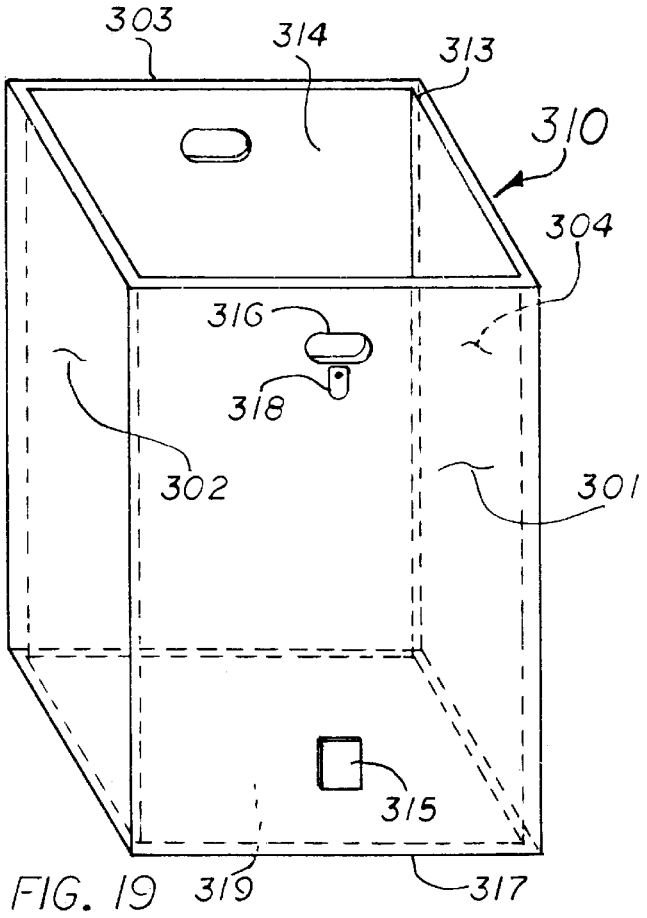
FIG. 19 is a perspective view of a box-shaped shield according to an aspect of the present invention.

FIG. 19 shows a box-shaped shield 310. Such a shape is advantageous when certain types of bags are to be used. For example, paper bags typically have four flat sides and a flat bottom. Shield 310 is formed from four flat sections 301, 302, 303, and 304, which are suitably joined together in a releasable fashion. When shield 310 is to be stored, the sections 301–304 may be disassembled and stacked on top of each other. Base 320 may then be arranged with collapsed sections 301–304 to form a stack of planar sections, which may be stored in a compact planar package. In a variation of shield 310, adjoining sections (e.g. sections 301 and 304) may be connected by a flexible section of material. This variation of shield 310 may be collapsed into a flattened form, with sections 301 and 302 lying in the same plane and facing sections 303 and 304.

Shield 310 has an upper shield opening 314 (defined by rim 313) and a lower shield opening 319 (defined by rim 317). Rim 313 and rim 314 are defined by the upper and lower portions, respectively, of sections 301–304. Upper shield opening 314 preferably has an area almost as large as a suitable paper bag. For example, certain municipalities require a specific type of paper bag to be used for disposal of yard waste. To fit into such a bag, shield 310 may be configured so that upper shield opening 314 has 16 inches of length and 12 inches of width. Such a variation of shield 310 preferably has a height of about 34 inches. In another variation of shield 310 for use with a convention grocery sack, opening 314 preferably has dimensions of 12 inches by 7 inches and shield 310 is preferably about 14 inches high.

Figure 21:
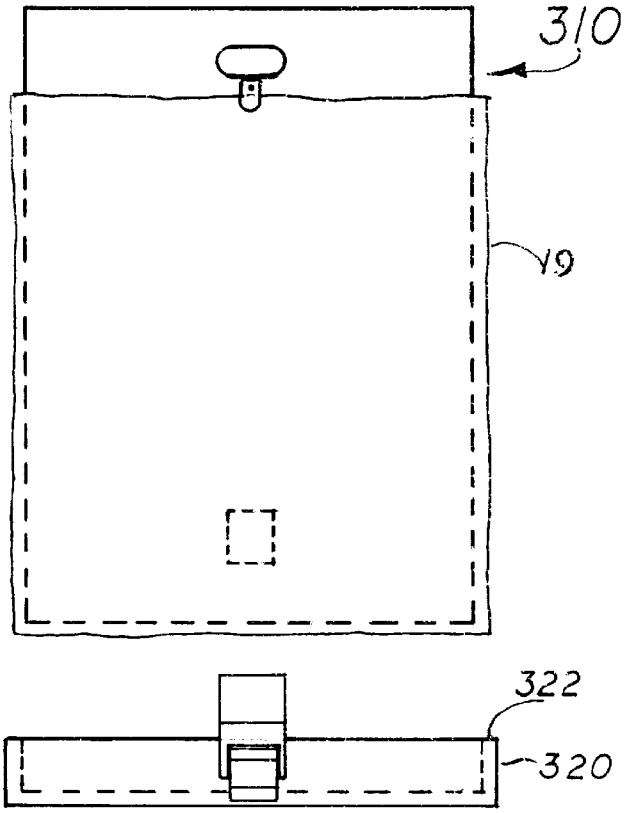
FIG. 21 shows a shield of the present invention placed partially into a bag and onto a base.
Figure 22:
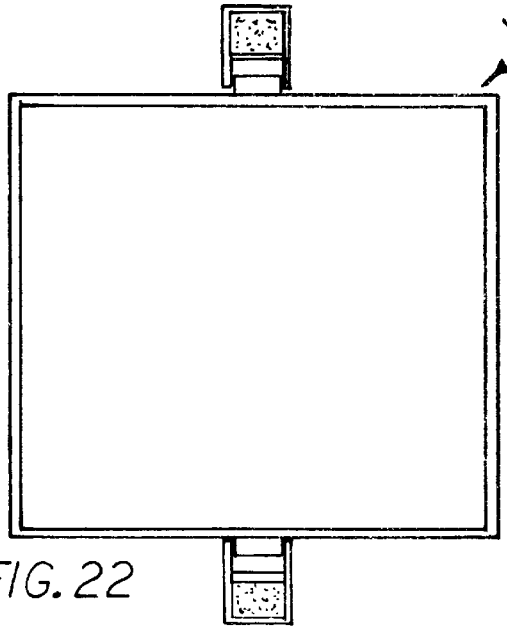
FIG. 22 is a top view of a rectangular base according to an aspect of the present invention.

FIG. 21 shows shield 310 placed partially into a paper bag 19. Base 320 rests below bag 19 such that raised outer lip 322 extends up and around the bottom of bag 19.

Shield 310 may include handles and clips such as those shown on shields 110 and 210 for securing bag 19 to shield 310. However, such clips may be suitably omitted if, for example, bag 19 is sufficiently rigid to support itself with shield 310 inserted inside it. In a variation of shield 310 small enough to be conveniently pulled up and out of bag 19 without handles, no handles are included. Alternatively, rim 313 of upper shield opening 314 may be thickened to provide a handgrip for pulling up on shield 310.

Shield 310 includes a metallic seat 315, which is secured to a magnet 325 on base 320 in a releasable fashion. Seat 315 and magnet 325 secure base 320 and shield 310 together through bag 19 by magnetic attraction. Alternatively, base 320 and shield 310 may be secured together through a suitable mechanical latch having mating sections that can engage each other through bag 19.

Figure 4:
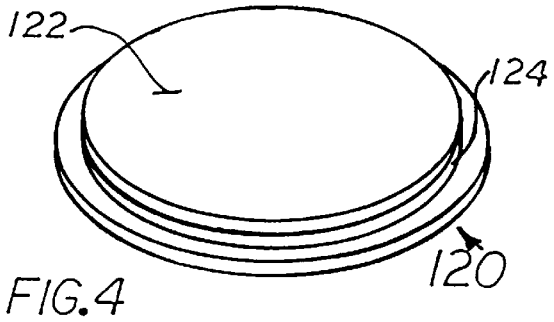
FIG. 4 is a perspective view of a circular base according to an aspect of the present invention.

Any suitable base may be secured to any suitable shield, examples of which have been described above, to support and protect the bag during compacting of waste into the bag. For example, base 120 (FIG. 4) may be secured to shield 110, as shown in FIG. 2. As discussed above, base 120 is secured to shield 110 with the aid of a raised inner face 122 having a base coupling lip 124 around its edge.

Figure 8:
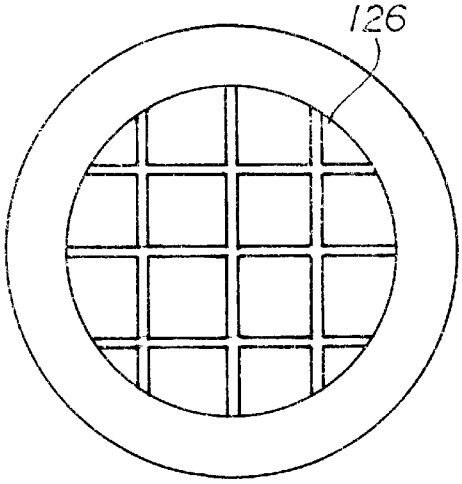
FIG. 8 is a bottom view of a circular base having an external structural grid according to an aspect of the present invention.
Figure 15:
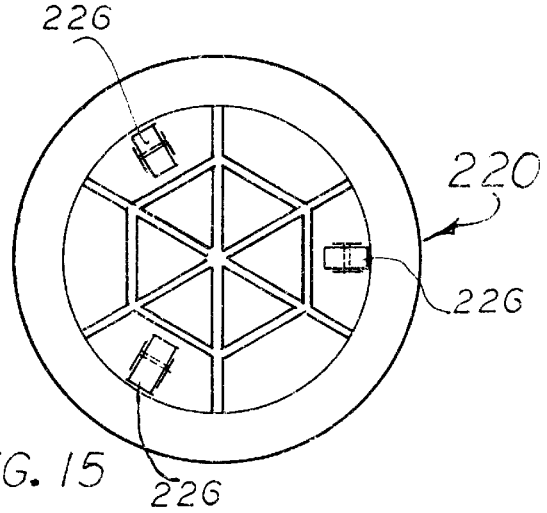
FIG. 15 is a bottom view of a base having an external structural grid according to an aspect of the present invention.
Figure 23:
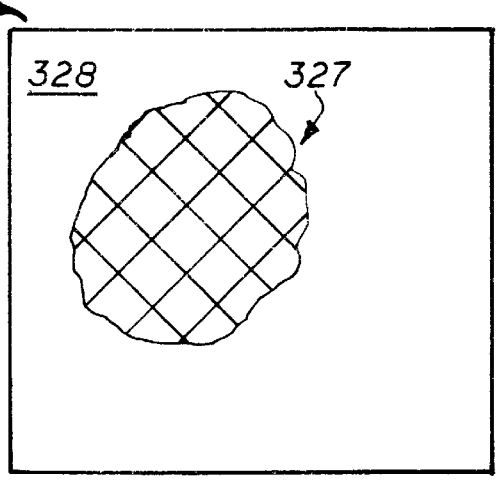
FIG. 23 is a bottom view of a rectangular base having an internal structural grid according to an aspect of the present invention.

A base of the present invention may be formed with any suitable structure that can be secured to a shield (in a releasable fashion) to support the shield and a bag. If it is desired that such a base be heavy to add stability to the overall apparatus comprising base and shield, the base may be made of solid material. Alternatively, a structure may be incorporated into the base to provide rigidity without requiring as much material as a solid base would need. For example, FIG. 8 shows a structural grid 126 on the bottom of base 120. Similarly, FIG. 15 shows a structural grid 226 on base 220. FIG. 23 shows a cutaway view of a structural grid 327 inside base 320, which is normally obscured by a bottom face 328.

Figure 11:
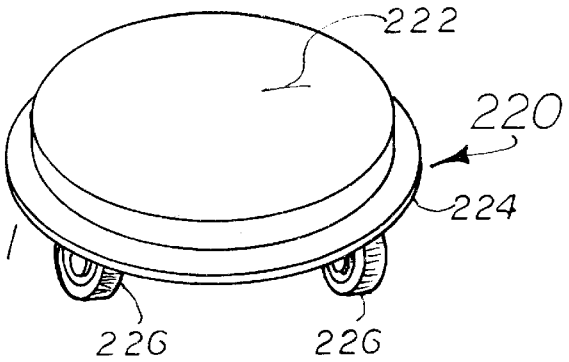
FIG. 11 is a perspective view of a circular base with wheels according to an aspect of the present invention.
Figure 12:
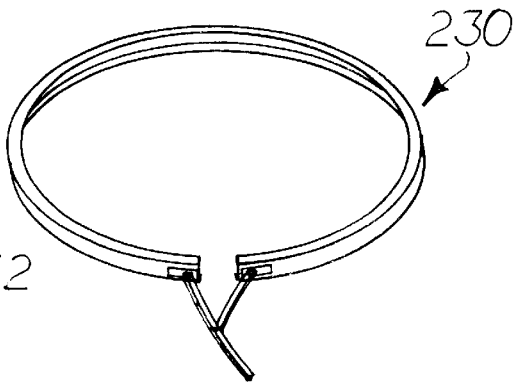
FIG. 12 is a perspective view of a clip ring according to an aspect of the present invention.
Figure 14:
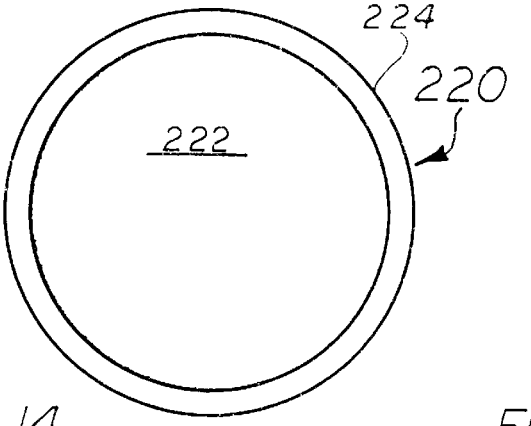
FIG. 14 is a top view of a base having a raised inner face according to an aspect of the present invention.

FIG. 11 shows base 220 having a raised inner face 222 and wheels 226. Wheels 226 may be of a type and arrangement commonly found on the bottom of waste receptacles. As discussed above, base 220 has an outward-extending lip 224 for receiving the bottom surface of corresponding lip 215 on shield 210. Top and bottom views of base 220 are shown in FIG. 14 and FIG. 15, respectively.

Figure 20:
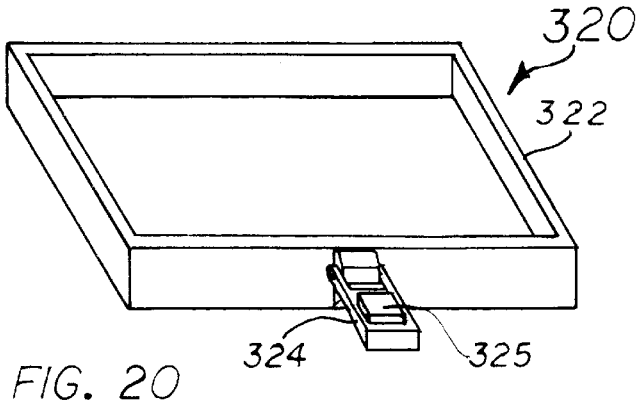
FIG. 20 is a perspective view of a rectangular base according to an aspect of the present invention.

FIG. 20 shows a rectangular base 320 suitable for use with a paper bag. Base 320 has a raised outer lip 322 extends up and around the bottom of such a bag. Base 320 includes a latch 324 with a magnetic face 325. FIG. 18 shows the arrangement of latch 324 before it is magnetically attached to metallic seat 315 on shield 310. Base 320 is secured to shield 310, with a bag sandwiched between, by magnetic attachment of latch 324 to metallic seat 315. A mechanical latch may also be used, although latch 324 and any suitable receiving mechanism that is used on shield 310 should be designed to make an effective and releasable mechanical connection with a bag sandwiched between them.

While the present invention has been described in terms of several preferred embodiments, it is contemplated that alterations and permutations thereof will become apparent to those skilled in the art upon a reading of the specification and study of the drawings. For example, the shield and base may be varied and still fall within the intent of the claims appended hereto. The present invention is intended to be defined only by the recited limitations of the claims, and equivalents thereof, rather than by the above description of preferred exemplary embodiments.

I claim:

1. Apparatus for supporting a bag on a surface and for protecting the bag during compacting of waste into the bag, the apparatus comprising:

(a) a shield having an upper shield opening and a lower shield opening;

(b) a base; and (c) a releasable ring clip, including a latch, for securing the base, in a releasable fashion, to the lower shield opening.

2. The apparatus of claim 1 wherein the ring clip is circular.

3. The apparatus of claim 1 wherein the ring clip is channeled.

4. A system for supporting a bag on a surface and for protecting the bag during compacting of waste into the bag, the system comprising:

(a) a shield having an upper shield opening and a lower shield opening;

(b) a bag positioned outside the shield such that the shield is at least partially inside the bag;

(c) a base adapted to be secured to the lower shield opening in a releasable fashion and positioned outside the bag; and (d) a releasable ring clip, including a latch, the clip securing the base, in a releasable fashion, to the lower shield opening.

5. The system of claim 4 wherein the ring clip is circular.

6. The system of claim 4 wherein the ring clip is channeled.

* * * * *